US011624284B2

(12) United States Patent
Lee et al.

(10) Patent No.: US 11,624,284 B2
(45) Date of Patent: Apr. 11, 2023

(54) IMPINGEMENT JET COOLING STRUCTURE WITH WAVY CHANNEL

(71) Applicants: DOOSAN ENERBILITY CO., LTD, Changwon (KR); INDUSTRY-ACADEMIC COOPERATION FOUNDATION YONSEI UNIVERSITY, Seoul (KR)

(72) Inventors: Chang Yong Lee, Sejong (KR); Hyung Hee Cho, Seoul (KR); Min Ho Bang, Gimpo (KR); Tae Hyun Kim, Seoul (KR); Ho Seop Song, Seoul (KR)

(73) Assignee: DOOSAN ENERBILITY CO., LTD., Changwon (KR)

( * ) Notice: Subject to any disclaimer, the term of this patent is extended or adjusted under 35 U.S.C. 154(b) by 0 days.

(21) Appl. No.: 17/472,762

(22) Filed: Sep. 13, 2021

(65) Prior Publication Data

US 2022/0127963 A1 Apr. 28, 2022

(30) Foreign Application Priority Data

Oct. 23, 2020 (KR) ..... 10-2020-0137963

(51) Int. Cl.
*F01D 5/18* (2006.01)

(52) U.S. Cl.
CPC ..... *F01D 5/18* (2013.01); *F01D 5/187* (2013.01); *F01D 5/188* (2013.01); (Continued)

(58) Field of Classification Search
CPC . F01D 5/18; F01D 5/187; F01D 5/188; F05D 2220/32; F05D 2240/30; F05D 2260/201
See application file for complete search history.

(56) References Cited

U.S. PATENT DOCUMENTS 5,353,865 A * 10/1994 Adiutori ..... F28F 13/185 165/908
5,533,864 A * 7/1996 Nomoto ..... F23R 3/002 415/115

(Continued)

FOREIGN PATENT DOCUMENTS

EP 0889201 A1 1/1999
EP 1990507 A1 11/2008

(Continued)

OTHER PUBLICATIONS

KR OA dated Mar. 22, 2022.
EESR dated Mar. 17, 2002.
KR Office Action, dated Aug. 23, 2022.

*Primary Examiner* — Igor Kershteyn
*Assistant Examiner* — Theodore C Ribadeneyra
(74) *Attorney, Agent, or Firm* — Harvest IP Law LLP

(57) ABSTRACT

An impingement cooling structure is provided. The impingement cooling structure includes a flow channel formed between a first wall and a second wall facing the first wall, a plurality of impingement cooling holes disposed in the first wall such that the plurality of impingement cooling holes are spaced apart from each other along the flow channel, and a flow diverter convexly protruding from a surface of the second wall in each space between injection axes of the plurality of impingement cooling holes.

15 Claims, 6 Drawing Sheets

(52) U.S. Cl.
CPC ..... *F05D 2220/32* (2013.01); *F05D 2240/30* (2013.01); *F05D 2260/201* (2013.01)

(56) References Cited

U.S. PATENT DOCUMENTS

| | | | | |
|---|---|---|---|---|
| 5,586,866 | A * | 12/1996 | Wettstein | F23R 3/002 416/96 A |
| 6,000,908 | A * | 12/1999 | Bunker | F01D 5/189 415/176 |
| 6,439,846 | B1 * | 8/2002 | Anderson | F01D 5/187 416/96 A |
| 6,484,505 | B1 * | 11/2002 | Brown | F23R 3/002 60/760 |
| 7,572,102 | B1 | 8/2009 | Liang | |
| 8,169,779 | B2 * | 5/2012 | Le | H01L 23/4735 361/689 |
| 8,667,682 | B2 * | 3/2014 | Lee | F01D 9/023 60/39.01 |
| 8,840,371 | B2 * | 9/2014 | Simpson | F01D 5/187 416/97 R |
| 8,894,367 | B2 * | 11/2014 | Lee | F01D 5/187 165/184 |
| 9,133,717 | B2 * | 9/2015 | Nakamata | F01D 5/186 |
| 9,347,324 | B2 * | 5/2016 | Lee | F01D 5/188 |
| 9,771,809 | B2 * | 9/2017 | Fujimoto | F23R 3/002 |
| 9,810,071 | B2 * | 11/2017 | Papple | F01D 5/18 |
| 9,957,812 | B2 * | 5/2018 | Okita | F01D 5/189 |
| 10,352,566 | B2 * | 7/2019 | Drake | F23R 3/005 |
| 10,422,235 | B2 * | 9/2019 | Bunker | F01D 9/065 |
| 10,443,399 | B2 | 10/2019 | Jones | |
| 10,508,808 | B2 * | 12/2019 | Drake | F23R 3/60 |
| 10,641,099 | B1 * | 5/2020 | Waite | F23R 3/002 |
| 10,968,755 | B2 * | 4/2021 | Bang | F01D 5/18 |
| 11,078,847 | B2 * | 8/2021 | Porter | F23R 3/002 |
| 11,112,114 | B2 * | 9/2021 | Pritchard | F23R 3/06 |
| 11,131,199 | B2 * | 9/2021 | Romanov | F01D 5/186 |
| 11,280,215 | B2 * | 3/2022 | Bergholz | F23R 3/06 |
| 2002/0062945 | A1 * | 5/2002 | Hocker | F01D 5/189 165/53 |
| 2010/0034638 | A1 * | 2/2010 | Chambers | F01D 25/12 415/115 |
| 2011/0033312 | A1 * | 2/2011 | Lee | F01D 5/187 416/97 R |
| 2014/0109577 | A1 * | 4/2014 | Lee | F01D 9/023 60/722 |
| 2014/0238028 | A1 * | 8/2014 | Yamane | F23R 3/06 60/752 |
| 2014/0290256 | A1 * | 10/2014 | Fujimoto | F01D 5/187 60/752 |
| 2014/0290257 | A1 * | 10/2014 | Okita | F23R 3/005 60/752 |
| 2021/0131290 | A1 * | 5/2021 | Romanov | F01D 25/246 |
| 2021/0131292 | A1 * | 5/2021 | Domnick | F01D 25/08 |

FOREIGN PATENT DOCUMENTS

| | | | |
|---|---|---|---|
| EP | 2233693 | A1 | 9/2010 |
| EP | 3816407 | A1 | 5/2021 |
| JP | 59108053 | U | 7/1984 |
| JP | H11159301 | A | 6/1999 |
| JP | 2015063997 | A | 4/2015 |
| KR | 20170102469 | A | 9/2017 |
| WO | 2010086381 | A1 | 8/2010 |
| WO | 2016025054 | A1 | 2/2016 |

* cited by examiner

IMPINGEMENT JET COOLING STRUCTURE WITH WAVY CHANNEL

CROSS REFERENCE TO RELATED APPLICATION

This application claims priority to Korean Patent Application No. 10-2020-0137963, filed on Oct. 23, 2020, the disclosure of which is incorporated herein by reference in its entirety.

FIELD

Apparatuses and methods consistent with exemplary embodiments relate to an impingement jet cooling structure in which a plurality of impingement cooling holes are arranged in a row in a single cooling path to reduce the effect of cross flow in the cooling structure to achieve a uniform cooling effect.

BACKGROUND

A turbine is a mechanical device that obtains a rotational force by an impact force or reaction force using a flow of a compressible fluid such as steam or gas. The turbine includes a steam turbine using a steam and a gas turbine using a high temperature combustion gas.

The gas turbine includes a compressor, a combustor, and a turbine. The compressor includes an air inlet into which air is introduced, and a plurality of compressor vanes and compressor blades which are alternately arranged in a compressor casing.

The combustor supplies fuel to the compressed air compressed in the compressor and ignites a fuel-air mixture with a burner to produce a high-temperature and high-pressure combustion gas.

The turbine includes a plurality of turbine vanes and turbine blades disposed alternately in a turbine casing. Further, a rotor is arranged passing through center of the compressor, the combustor, the turbine and an exhaust chamber.

The rotor is rotatably supported at both ends thereof by bearings. A plurality of disks are fixed to the rotor and the plurality of blades are connected to each of the disks while a drive shaft of a generator is connected to an end of the rotor that is adjacent to the exhaust chamber.

The gas turbine does not have a reciprocating mechanism such as a piston which is usually provided in a four-stroke engine. That is, the gas turbine has no mutual frictional parts such as a piston-cylinder mechanism, thereby having advantages in that consumption of lubricant is extremely small, an amplitude of vibration as a characteristic of a reciprocating machine is greatly reduced, and high-speed operation is possible.

Briefly describing the operation of the gas turbine, the compressed air compressed by the compressor is mixed with fuel and combusted to produce a high-temperature combustion gas, which is then injected toward the turbine. The injected combustion gas passes through the turbine vanes and the turbine blades to generate a rotational force by which the rotor is rotated.

The factors that affect the efficiency of gas turbines vary widely. Recent development of gas turbines has been progressing in various aspects such as improvement of combustion efficiency in a combustor, improvement of thermodynamic efficiency through an increase in turbine inlet temperature, and improvement of aerodynamic efficiency in a compressor and a turbine.

The types of industrial gas turbines for power generation can be classified depending upon turbine inlet temperature (TIT), currently G-class and H-class gas turbines are generally considered the highest class, and some of the newest gas turbines are rated to have reached J-class. The higher the grade of the gas turbine, the higher both the efficiency and the turbine inlet temperature. H-class gas turbine has a turbine inlet temperature of 1,500° C., which necessitates the development of heat-resistant materials and cooling technologies.

Heat resistant design is required throughout gas turbines, which is particularly important in combustors and turbines where hot combustion gases are generated and flow. Gas turbines are cooled in an air-cooled scheme using compressed air produced by a compressor. In the case of a turbine, the cooling design is more difficult to obtain due to the complex structure in which turbine vanes are fixedly arranged between turbine blades rotating over several stages.

In the turbine vane and the turbine blade, a serpentine flow path is formed in a longitudinal direction (i.e., a radial direction), and a plurality of cooling holes and cooling slots are formed to protect the turbine vane and the turbine blade from a high temperature thermal stress environment and to allow compressed air to flow therethrough. This flow path is called a serpentine cooling path, and the compressed air flowing through the serpentine flow path communicates with cooling holes and cooling slots to cool various parts of the turbine vane and turbine blade, thereby causing impingement cooling (i.e., impact jet cooling) and film cooling.

Impingement cooling uses a high pressure compressed air that directly impinges a high-temperature target surface for cooling, whereas film cooling uses an air film with very low thermal conductivity that forms on a target surface exposed to a high-temperature environment to cool the target surface while suppressing heat transfer to the target surface from the high-temperature environment. Composite cooling is also performed in the turbine vane and the turbine blade to provide impingement cooling on an inner surface of the flow path and film cooling on an outer surface of the flow path, thereby protecting the turbine vane and the turbine blade from a high temperature environment.

In order to apply impingement jet cooling to a wide area, it is necessary to design an impingement jet cooling structure in which a plurality of impingement cooling holes are arranged in a row in a single cooling path. However, in the impingement jet cooling structure, a transverse flow (i.e., a cross flow) in which the jets impinging the cooling surface flows toward a path outlet along a wall occurs so that the jet direction of the impingement jets is gradually deflected toward the path outlet as it goes downstream. The deflection of the impinging jets becomes stronger when the path outlet is formed only in one direction, resulting in non-uniform distribution in heat transfer due to the deflected impingement jets.

This non-uniform heat transfer distribution causes a thermal stress on the impingement surface, which negatively affects the life of the parts and should be addressed. In particular, considering the current development trend in which a turbine inlet temperature is gradually increasing to improve the efficiency of a gas turbine, it is expected that measures to relieve the thermal stress will become more important in the future.

SUMMARY

Aspects of one or more exemplary embodiments provide an impingement cooling structure capable of effectively suppressing the deterioration in cooling effect due to cross flow occurring in the related art impingement cooling structure.

Additional aspects will be set forth in part in the description which follows and, in part, will become apparent from the description, or may be learned by practice of the exemplary embodiments.

According to an aspect of an exemplary embodiment, there is provided an impingement cooling structure including: a flow channel formed between a first wall and a second wall facing the first wall; a plurality of impingement cooling holes disposed in the first wall such that the plurality of impingement cooling holes are spaced apart from each other along the flow channel; and a flow diverter convexly protruding from a surface of the second wall in each space between injection axes of the plurality of impingement cooling holes.

A cross-sectional shape of the flow diverter with respect to a plane including the injection axes may be a triangular cross-sectional shape in which both sides form ridges.

The cross-sectional shape of the flow diverter with respect to the plane including the injection axes may be configured such that the ridges form a planar shape.

A top portion in which the ridges meet may form a planar shape.

The cross-sectional shape of the flow diverter with respect to the plane including the injection axes may be a triangular cross-sectional shape forming a continuous curved surface.

The first wall may include a plurality of indentations concavely recessed along the flow channel toward a space between the flow diverters, and the plurality of impingement cooling holes may be disposed in the indentation.

A central axis of the flow diverter may face a middle portion between the indentations, and the injection axis of the impingement cooling hole may face a middle portion between the flow diverters.

An angle of the indentation with respect to the first wall may be greater than an angle of the flow diverter with respect to the second wall.

The flow diverter may include a bypass channel passing through the ridges of both sides along the flow channel.

A flow axis of the bypass channel may be arranged across the injection axis of adjacent impingement cooling hole.

The first wall may be a cold wall and the second wall may be a hot wall.

The first wall may be a flow sleeve of a combustor and the second wall may be a liner or transition piece of the combustor.

The first wall may be an inner wall defining a cavity of a turbine vane, and the second wall may be an outer wall spaced apart from the inner wall and defining a contour of the turbine vane.

The first wall may be an inner wall defining a cavity of a turbine blade, and the second wall may be an outer wall spaced apart from the inner wall and defining a contour of the turbine blade.

According to the impingement cooling structure according to one or more exemplary embodiments, after colliding with the cooling surface, the impingement jet injected through the impingement cooling holes flows into the convexly protruding flow diverter while flowing in the transverse direction and rises along the ridge of the flow diverter, so that interference with a flow of surrounding impinging jets decreases. As a result, the deflection of the impinging jet by the cross flow is reduced, and the cooling effect of the impinging jet is sufficiently secured.

In addition, the first and second walls define a wavy flow channel in which the recesses of the first wall and the flow diverters of the second wall are alternately arranged to form an overall uniform heat transfer distribution and guide the smooth flow of the cooling fluid.

BRIEF DESCRIPTION OF THE DRAWINGS

The above and other aspects will become more apparent from the following description of the exemplary embodiments with reference to the accompanying drawings, in which.

DETAILED DESCRIPTION

Figure 1:
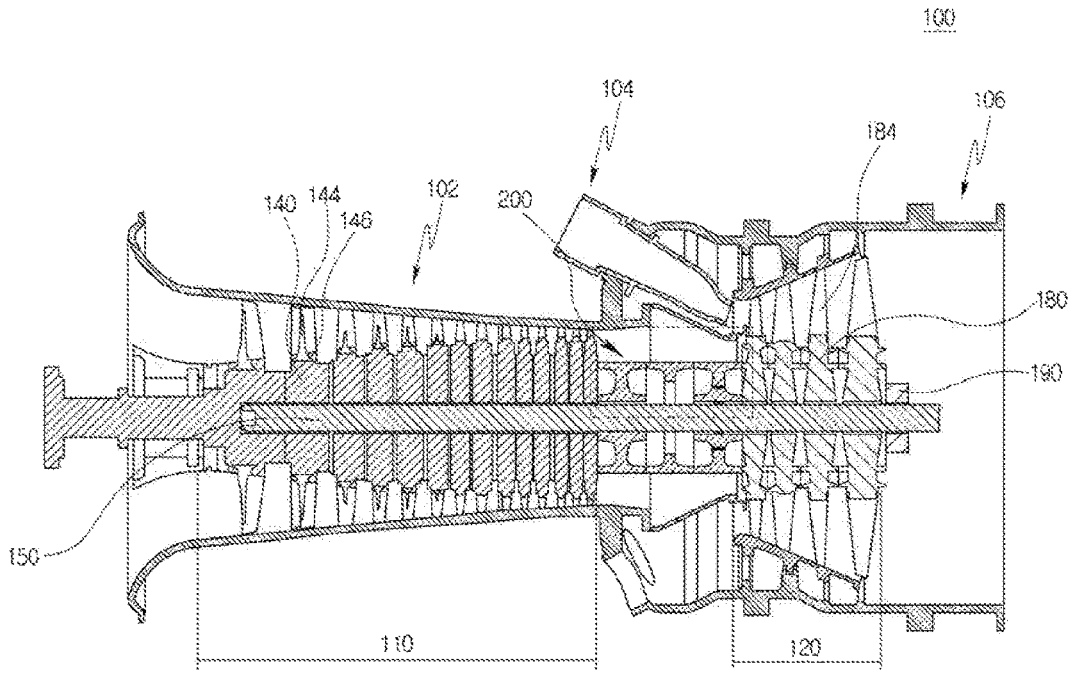
FIG. 1 is a cross-sectional view illustrating an overall configuration of a gas turbine to which an impingement jet cooling structure can be applied according to an exemplary embodiment.

Various modifications and various embodiments will be described in detail with reference to the accompanying drawings so that those skilled in the art can easily carry out the disclosure. It should be understood, however, that the various embodiments are not for limiting the scope of the disclosure to the specific embodiment, but they should be interpreted to include all modifications, equivalents, and alternatives of the embodiments included within the spirit and scope disclosed herein.

Terms used herein are for the purpose of describing specific embodiments only and are not intended to limit the scope of the disclosure. As used herein, an element expressed as a singular form includes a plurality of elements, unless the context clearly indicates otherwise. Further, terms such as "comprising" or "including" should be construed as designating that there are such feature, number, step, operation, element, part, or combination thereof, not to exclude the presence or addition of one or more other features, numbers, steps, operations, elements, parts, or combinations thereof.

Hereinafter, exemplary embodiments will be described in detail with reference to the accompanying drawings. It is noted that like reference numerals refer to like parts throughout the different drawings and exemplary embodiments. In certain embodiments, a detailed description of known functions and configurations well known in the art will be omitted to avoid obscuring appreciation of the disclosure by a person of ordinary skill in the art. For the same reason, some elements are exaggerated, omitted, or schematically illustrated in the accompanying drawings.

FIG. 1 is a cross-sectional view illustrating an overall configuration of a gas turbine to which an impingement jet cooling structure can be applied according to an exemplary embodiment. Referring to FIG. 1, a gas turbine 100 includes a housing 102 and a diffuser 106 disposed behind the housing 102 to discharge a combustion gas passing through a turbine. A combustor 104 is disposed in front of the diffuser 106 to combust compressed air supplied thereto.

Based on a flow direction of the air, a compressor section 110 is located at an upstream side 2, and a turbine section 120 is located at a downstream side. A torque tube 130 serving as a torque transmission member to transmit the rotational torque generated in the turbine section 120 to the compressor section 110 is disposed between the compressor section 110 and the turbine section 120.

The compressor section 110 includes a plurality of compressor rotor disks 140, each of which is fastened by a tie rod 150 to prevent axial separation in an axial direction of the tie rod 150.

For example, the compressor rotor disks 140 are axially arranged in a state in which the tie rod 150 constituting a rotary shaft passes through centers of the compressor rotor disks 140. Here, neighboring compressor rotor disks 140 are disposed so that facing surfaces thereof are in tight contact with each other by being pressed by the tie rod 150. The neighboring compressor rotor disks 140 cannot rotate because of this arrangement.

A plurality of blades 144 are radially coupled to an outer circumferential surface of the compressor rotor disk 140. Each of the compressor blades 144 has a root portion 146 which is fastened to the compressor rotor disk 140.

A plurality of compressor vanes are fixedly arranged between each of the compressor rotor disks 140 in the housing 102. While the compressor rotor disks 140 rotate along with a rotation of the tie rod 150, the compressor vanes fixed to the housing 102 do not rotate. The compressor vane guides a flow of compressed air moved from front-stage compressor blades 144 of the compressor rotor disk 140 to rear-stage compressor blades 144 of the compressor rotor disk 140. Here, terms "front" and "rear" may refer to relative positions determined based on the flow direction of compressed air.

A coupling scheme of the root portion 146 which are coupled to the compressor rotor disks 140 is classified into a tangential type and an axial type. These may be chosen according to the required structure of the commercial gas turbine, and may have a dovetail shape or fir-tree shape. In some cases, the compressor blade 144 may be coupled to the compressor rotor disk 140 by using other types of fasteners such as keys or bolts.

The tie rod 150 is arranged to pass through centers of the compressor rotor disks 140 such that one end thereof is fastened to the most upstream compressor rotor disk and the other end thereof is fastened by a fixing nut 190.

It is understood that the shape of the tie rod 150 is not limited to the example illustrated in FIG. 1, and may have a variety of structures depending on the gas turbine. For example, a single tie rod may be disposed to pass through central portions of the rotor disks, a plurality of tie rods may be arranged circumferentially, or a combination thereof may be used.

Also, a deswirler serving as a guide vane may be installed at the rear stage of the diffuser in order to adjust a flow angle of a pressurized fluid entering a combustor inlet to a designed flow angle.

The combustor 104 mixes the introduced compressed air with fuel, combusts the air-fuel mixture to produce a high-temperature and high-pressure combustion gas, and increases the temperature of the combustion gas is increased to the heat resistance limit that the combustor and the turbine components can withstand through an isobaric combustion process.

A plurality of combustors constituting the combustor 104 may be arranged in the casing in a form of a cell. Each of the combustors includes a burner having a fuel injection nozzle and the like, a combustor liner forming a combustion chamber, and a transition piece as a connection between the combustor and the turbine.

The combustor liner provides a combustion space in which the fuel injected by the fuel injection nozzle is mixed with the compressed air supplied from the compressor and the fuel-air mixture is combusted. The combustor liner may include a flame canister providing a combustion space in which the fuel-air mixture is combusted, and a flow sleeve forming an annular space surrounding the flame canister. The fuel injection nozzle is coupled to a front end of the combustor liner, and an igniter is coupled to a side wall of the combustor liner.

The transition piece is connected to a rear end of the combustor liner to transmit the combustion gas to the turbine. An outer wall of the transition piece is cooled by the compressed air supplied from the compressor to prevent the transition piece from being damaged by the high temperature combustion gas.

To this end, the transition piece is provided with cooling holes through which compressed air is injected into and cools inside of the transition piece and flows towards the combustor liner.

The compressed air that has cooled the transition piece flows into the annular space of the combustor liner and is supplied as a cooling air to an outer wall of the combustor liner from the outside of the flow sleeve through cooling holes provided in the flow sleeve so that air flows may collide with each other.

The high-temperature and high-pressure combustion gas ejected from the combustor 104 is supplied to the turbine section 120. The supplied high-temperature and high-pressure combustion gas expands and collides with and provides a reaction force to rotating blades of the turbine to generate a rotational torque. A portion of the rotational torque is transmitted to the compressor section through the torque tube, and remaining portion which is an excessive torque is used to drive a generator or the like.

The turbine section 120 is basically similar in structure to the compressor section 110. That is, the turbine section 120 also includes a plurality of turbine rotor disks 180 similar to the compressor rotor disks of the compressor section. Thus, the turbine rotor disk 180 also includes a plurality of turbine blades 184 disposed radially. The turbine blade 184 may also be coupled to the turbine rotor disk 180 in a dovetail coupling manner. Between the turbine blades 184 of the turbine rotor disk 180, a plurality of vanes fixed to the housing are provided to guide a flow direction of the combustion gas passing through the turbine blades 184.

Hereinafter, an impingement jet cooling structure according to an exemplary embodiment will be described. First, a related art impingement jet cooling structure will be described with reference to FIG. 2.

The impingement jet cooling is a cooling method in which cooling air is sprayed directly onto a target surface, which is widely applied to a combustor of a gas turbine or a turbine vane and/or a turbine blade of a turbine section, because the method provides a highly efficient local heat/mass transfer. The impingement jet cooling area is divided into three regions: a free jet region that is not affected by the impact surface; a stagnation region that is formed after the impingement jet collides with the impact surface; and a wall jet region in which the impingement jet increases in magnitude as it flows along the impact surface after colliding with the impact surface.

When the impingement cooling holes are arranged in series, high heat transfer occurs locally between the impingement cooling holes due to the interaction between the wall jets formed in adjacent impingement jets. Effective heat transfer over a wide area can be achieved by using an array of impingement jets that uses multiple impingement jets simultaneously instead of a single impingement jet using these characteristics.

However, in the impingement jets array, after the jets injected from the impingement cooling holes collide with a target surface (i.e., cooling surface), the fluid flows out while flowing in a direction perpendicular to the injecting jets (i.e., transverse direction). This transverse flow (i.e., cross-flow) deflects the injecting jets located downstream, causing the injecting jets to gradually deviate from the target cooling point at which the jets were originally directed as the jets flow downstream.

Figure 2:
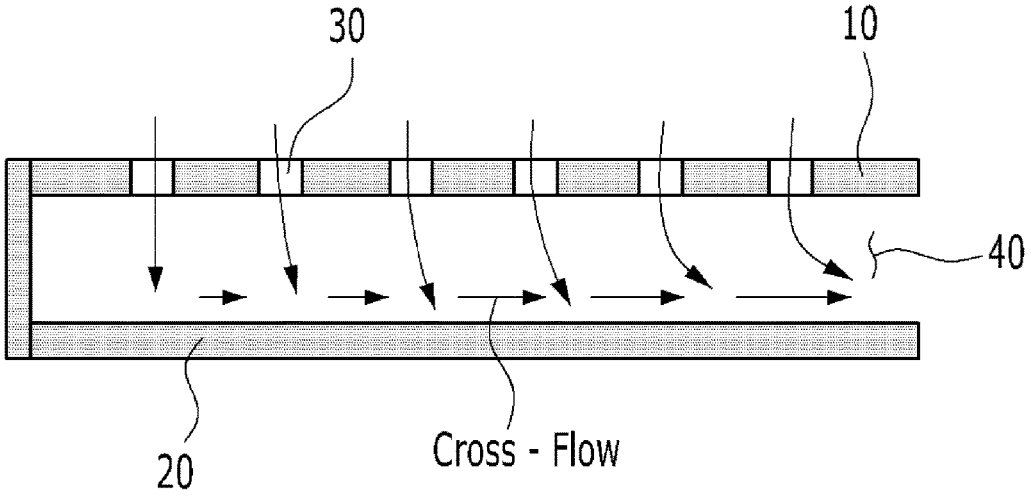
FIG. 2 is a view illustrating a related art impingement jet cooling structure.

FIG. 2 is a view illustrating a related art impingement jet cooling structure and illustrates the effect of the cross-flow, in which the deflection becomes even greater especially when an outlet of a flow channel is formed in only one direction. Referring to FIG. 2, a plurality of impingement cooling holes 30 are arranged in a first wall 10 and the injecting jets collide with a surface of a second wall 20 corresponding to the cooling surface. The injecting jets are originally intended to collide with the surface of the second wall 20 facing the impingement cooling holes 30, but the injecting jets are strongly deflected as they flow downstream under the influence of the cross-flow flowing through the flow channel 40 along the second wall 20. In this way, the cross-flow generated by the impingement jets array causes the injecting jets to collide non-uniformly with the cooling surface (i.e., impact surface), thereby reducing the overall heat transfer effect and resulting in a non-uniform heat transfer distribution over the entire impact surface. This non-uniform heat transfer distribution causes a thermal stress on the impact surface, which negatively affects the lifetime of parts.

Figure 3:
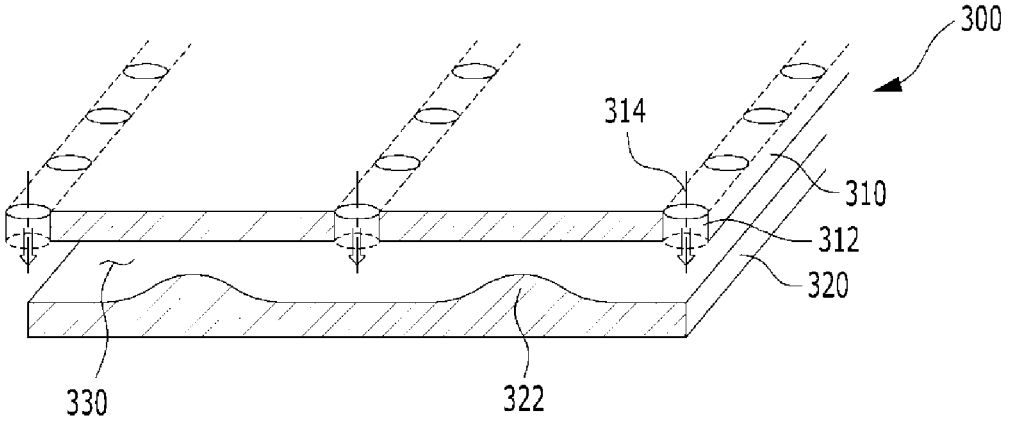
FIG. 3 is a view illustrating an impingement jet cooling structure according to an exemplary embodiment.

The impingement cooling structure according to the exemplary embodiment is devised to reduce the effect of cross-flow in such an impingement jet cooling structure to realize an excellent heat transfer effect and uniform heat transfer distribution. FIG. 3 is a view illustrating an impingement jet cooling structure 300 according to an exemplary embodiment.

Referring to FIG. 3, in the impingement jet cooling structure 300, a flow channel 330 is formed between a first wall 310 and a second wall 320 facing the first wall 310, and a plurality of impingement cooling holes 312 are formed in the first wall 310 to be spaced apart from each other along the flow channel 330. For example, on the surface of the second wall 320 forming the impact surface, a convexly protruding flow diverter 322 is provided in each space between injection axes 314 of the impingement cooling holes 312.

The flow diverter refers to a structure formed to protrude convexly in the region between the impact points of the injecting jets in the impingement cooling structure. For reference, in actual production, the second wall 320 and the flow diverter 322 may be integrally formed by press-molding or casting, but in consideration of the functional aspect, the flow diverter 322 will be described as a separate component.

The flow diverter 322 may be configured to convert the injecting jets into temporary reflux prior to collide with the cooling surface (i.e., second wall), the wall jets developing into a cross-flow while flowing along the impact surface affect other adjacent injecting jets.

Figure 4:
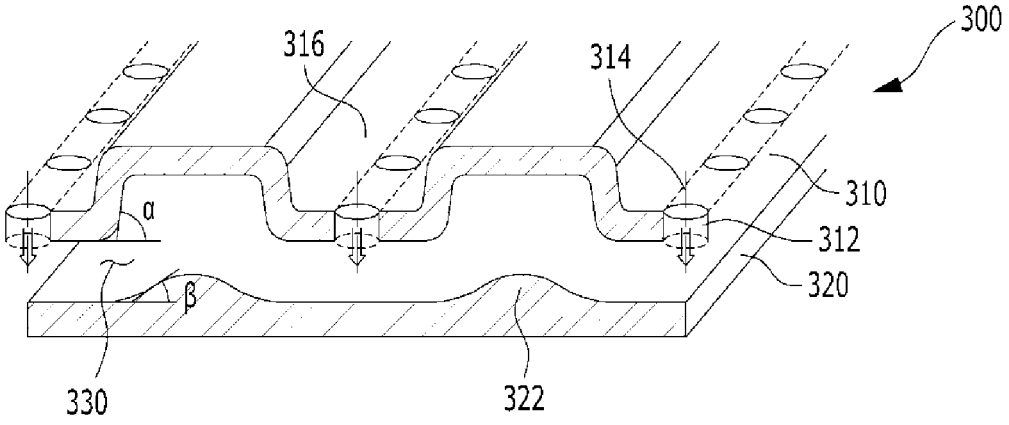
FIG. 4 is a view illustrating an impingement jet cooling structure according to another exemplary embodiment.

FIG. 4 is a view illustrating an impingement jet cooling structure 300 according to another exemplary embodiment. Compared with the impingement jet cooling structure 300 of FIG. 3, there is a difference in the configuration in which indentations 316 are repeatedly formed in the first wall 310. That is, in the first wall 310, a plurality of indentations 316 concavely recessed toward the space between the flow diverters 322 are sequentially spaced apart along the flow channel 330 such that impingement cooling holes 312 are disposed within indentation 316.

Figure 5:
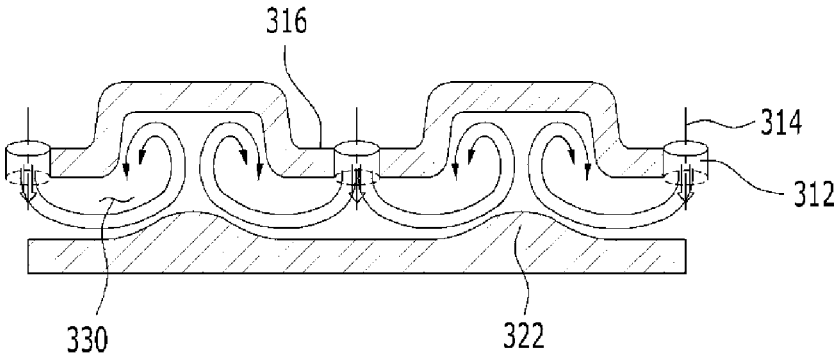
FIG. 5 is a view schematically illustrating a flow pattern shown in the impingement jet cooling structure of FIG. 4.

FIG. 5 is a view schematically illustrating a flow pattern shown in the impingement jet cooling structure of FIG. 4. Referring to FIG. 5, a cooling fluid of the impingement jets injected through the impingement cooling holes 312 flows into the convexly protruding flow diverter 322 while flowing in the transverse direction after colliding with the second wall 320, and rises along a ridge 323 of the flow diverter 322. In this process, the interference with a flow of surrounding impingement jets is reduced, thereby reducing the deflection of the impingement jets by the cross-flow. Accordingly, the cooling effect by the impingement jets is sufficiently large.

For example, as illustrated in FIG. 4, because the indentations 316 are formed in the first wall 310 between the flow diverters 322, expanded spaces defined by each wall surfaces of the indentations 316 are formed above the flow diverters 322. Accordingly, after colliding with the flow diverter 322, the cooling fluid flowing along the flow channel 330 rises along the ridge 323 of the flow diverter 322 and flows into the space of the indentation 316 between the impingement jets, thereby reducing the disturbance of the impingement jets and providing a uniform heat transfer distribution in the flow channel 330 due to the vortex generated in the indentations 316.

Here, for a more uniform distribution of heat transfer to the first and second walls 310 and 320 forming the flow channel 330, it may be desirable to have a symmetrical and balanced arrangement in which a central axis 324 of the flow diverter 322 faces a central portion between the indentations 316, and the injection axis 314 of the impingement cooling hole 312 faces the central portion between the flow diverters 322.

Also, the configuration may be configured such that an angle $\alpha$ made by the indentation 316 with respect to the first wall 310 is greater than an angle $\beta$ made by the flow diverter 322 with respect to the second wall 320. By increasing the angle $\alpha$ formed by the indentation 316 with respect to the first wall 310, the vortex and the injecting jets generated in the indentation 316 are more reliably separated or isolated, thereby preventing the impact effect of the injecting jets from being weakened. In contrast, by allowing the angle $\beta$ formed by the flow diverter 322 with respect to the second wall 320 to be formed more gently, the pressure loss due to an abrupt flow change of the wall jets can be reduced.

FIGS. 6 to 9 illustrate various exemplary embodiments of a flow diverter 322 provided in the impingement jet cooling structure 300.

Figure 6:
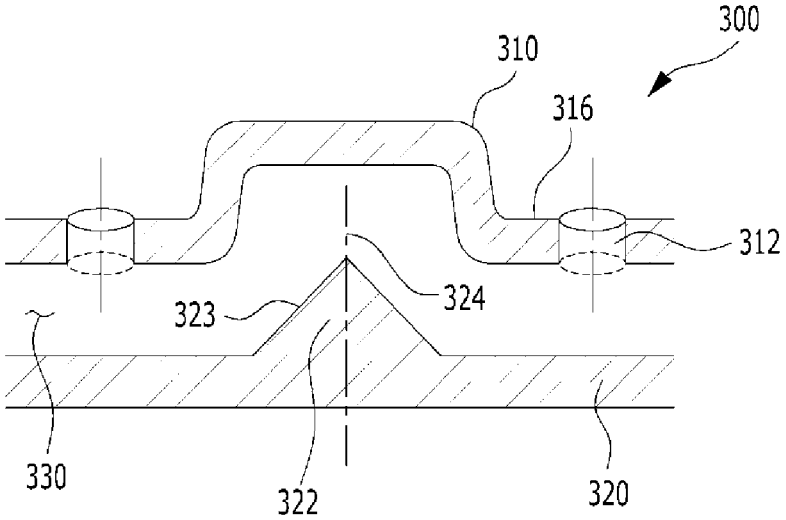
FIG. 6 illustrates an exemplary embodiment of a flow diverter.

Referring to FIG. 6, the flow diverter 322 is configured such that the cross-sectional shape of the flow diverter 322 with respect to a plane including the injection axis 314 is formed like a triangular cross-sectional shape in which both sides form ridges 323. In particular, the flow diverter 322 of FIG. 6 has the simplest form in which the ridges 323 on both sides form a planar shape. Here, inclined ridges 323 on both sides raise the cross-flow of the wall jets to form a reflux.

Figure 7:
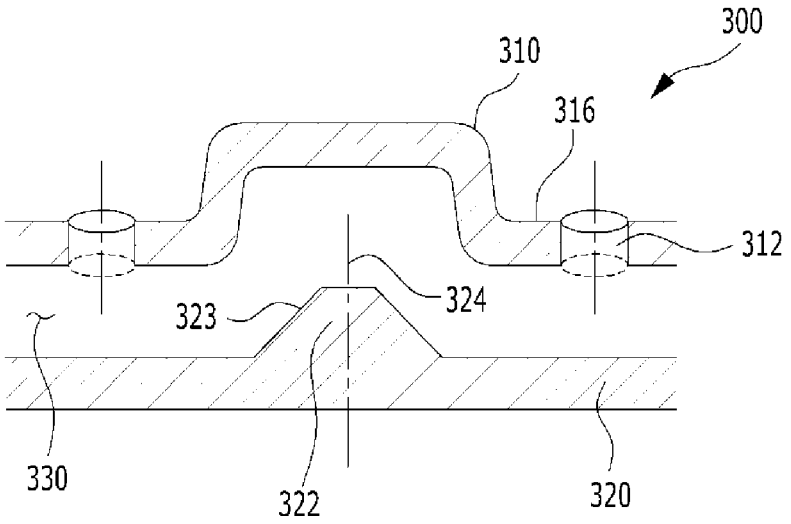
FIG. 7 illustrates another exemplary embodiment of a flow diverter.

FIG. 7 illustrates a modified example of the flow diverter 322 shown in FIG. 6. Referring to FIG. 7, the flow diverter 322 is configured such that a top portion in which the ridges 323 meet forms a flat plane. As the top portion of the flow diverter 322 is formed in planar, this exemplary embodiment is advantageous to restrict the strong collision of the cooling fluids rising along the ridges 323 on both sides, and to prevent the flow channel from being damaged by the sharp top portion of the flow diverter 322 being broken into pieces.

Figure 8:
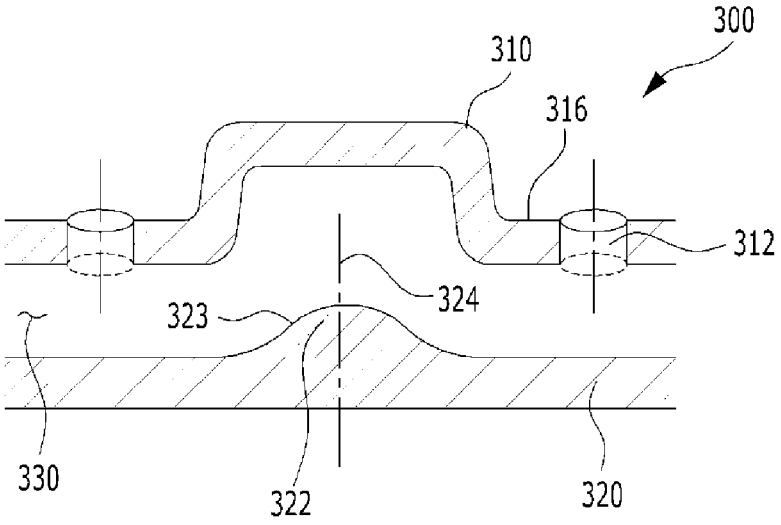
FIG. 8 illustrates another exemplary embodiment of a flow diverter.

FIG. 8 is a view illustrating another exemplary embodiment of the flow diverter 322, in which the cross-sectional shape of the flow diverter 322 with respect to a plane including the injection axis 314 of the impingement cooling hole 312 is a continuously curved shape, e.g., a triangular cross-sectional shape that forms a sine wave. The flow diverter 322 of FIG. 8 has a configuration similar to that of the flow diverter 322 of FIG. 7, and may have a shape most suitable to actually manufacture using a production technique such as press machining or casting. If the flow diverter 322 also employs the configuration of the indentation 316 formed in the first wall 310, the flow channel 330 forms a wavy flow path, thereby advantageously contributing to a smooth flow of the cooling fluid.

Figure 9:
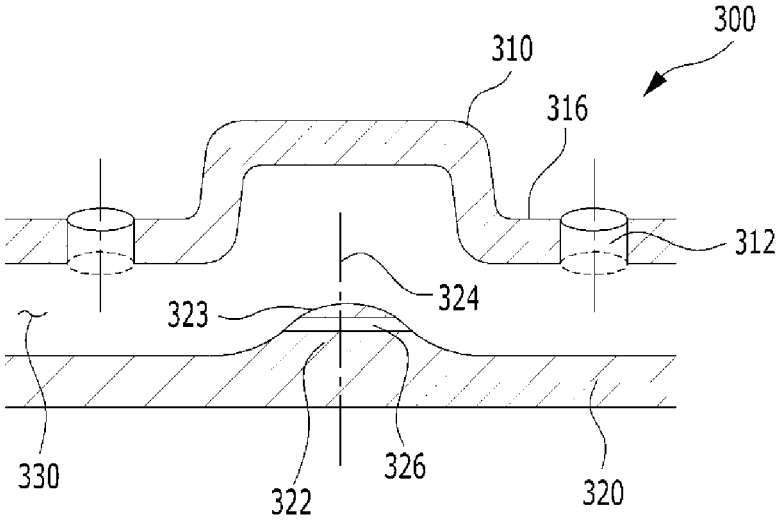
FIG. 9 illustrates an exemplary embodiment in which a bypass channel is formed in a flow diverter.

FIG. 9 is a view illustrating an exemplary embodiment in which a bypass channel 326 is formed in the flow diverter 322. The bypass channel 326 forms a narrow flow path through both ridges 323 of the flow diverter 322. The bypass channel 326 is an auxiliary channel for passing a portion of the wall jet in the transverse direction, so the bypass channel may be applied to design conditions in which there is a risk of excessive pressure loss due to reflux generated by the flow diverter 322 or otherwise it can be applied to the flow diverter 322 and the indentation 316.

The bypass channel 326 allows a portion of the wall jet to pass through in a form of a small cross-flow to reduce excessive pressure loss, and a flow axis of the bypass channel 326 is disposed (arranged) across the injection axis 314 of the adjacent impingement cooling hole 312 to provide a smooth flow through the bypass channel 326.

In the impingement jet cooling structure 300 having the configuration described above, the first wall 310 may be a low-temperature wall and the second wall 320 may be a high-temperature wall. As the cooling fluid flows outward along the first wall 310, the first wall 310 becomes a relatively cold wall, and the second wall 320 which forms the impact surface becomes a hot wall requiring cooling.

If this impingement jet cooling structure 300 is applied to the combustor 104 of the gas turbine, the first wall 310 may be a sleeve of the combustor, and the second wall 320 may be a liner or transition piece of the combustor.

In addition, the impingement jet cooling structure 300 according to the exemplary embodiments can be applied to the turbine section 120. For example, in the case of a turbine vane, the first wall 310 may be an inner wall defining the cavity of the turbine vane, and the second wall 320 may be an outer wall spaced relative to the inner wall to define the contour of the turbine vane. The space between the inner wall and the outer wall of the turbine vane forms a flow channel 330, and the impingement jet injected through the impingement cooling hole 312 in the inner wall cools the outer wall to thermally protect the turbine vane exposed to high temperature combustion gas.

Alternatively, similarly to the case of the turbine blade 184, the first wall 310 may be an inner wall defining the cavity of the turbine blade, and the second wall 320 may be an outer wall that is spaced apart from the inner wall and defines the contour of the turbine blade.

As described above, in the impingement cooling structure 300, after colliding with the second wall 320, the impingement jet injected through the impingement cooling holes 312 flows into the convexly protruding flow diverter 322 while flowing in the transverse direction and rises along the ridge 323 of the flow diverter 322, so that interference with a flow of surrounding impinging jets decreases. As a result, the deflection of the impinging jet by the cross flow is reduced, and the cooling effect of the impinging jet is sufficiently secured, so that it is suitable to apply to various mechanical devices, such as a gas turbine and parts thereof, through which a high-temperature fluid flows.

While one or more exemplary embodiments have been described with reference to the accompanying drawings, it is to be apparent to those skilled in the art that various modifications and variations in form and details can be made therein without departing from the spirit and scope as defined by the appended claims. Accordingly, the description of the exemplary embodiments should be construed in a descriptive sense only and not to limit the scope of the claims, and many alternatives, modifications, and variations will be apparent to those skilled in the art.

What is claimed is:

1. An impingement cooling structure comprising:

a flow channel formed, in a transverse direction, between a first wall and a second wall facing the first wall;

a plurality of impingement cooling holes disposed in the first wall such that the plurality of impingement cooling holes are spaced apart from each other along the transverse direction of the flow channel; and a flow diverter convexly protruding from a surface of the second wall in each space between injection axes of the plurality of impingement cooling holes, wherein the flow diverter includes a bypass channel, formed in the transverse direction, passing through ridges of both sides along the flow channel, the flow channel and the bypass channel being disposed in the same transverse direction, wherein a flow axis of the bypass channel is disposed to intersect with an axis of an adjacent impingement cooling hole from among the plurality of impingement cooling holes to provide a smooth flow of a cooling air injected from the adjacent impingement cooling hole through the bypass channel.

2. The impingement cooling structure according to claim 1, wherein a cross-sectional shape of the flow diverter with respect to a plane including the injection axes is a triangular cross-sectional shape in which both sides form the ridges.

3. The impingement cooling structure according to claim 2, wherein the cross-sectional shape of the flow diverter with respect to the plane including the injection axes is configured such that the ridges form a planar shape.

4. The impingement cooling structure according to claim 3, wherein a top portion in which the ridges meet forms a planar shape.

5. The impingement cooling structure according to claim 2, wherein the cross-sectional shape of the flow diverter with respect to the plane including the injection axes is a triangular cross-sectional shape forming a continuous curved surface.

6. The impingement cooling structure according to claim 2, wherein the first wall includes a plurality of indentations concavely recessed along the flow channel toward a space between the flow diverters, and the plurality of impingement cooling holes are disposed in the indentation.

7. The impingement cooling structure according to claim 6, wherein a central axis of the flow diverter faces a middle portion between the indentations, and the injection axis of the impingement cooling hole faces a middle portion between the flow diverters.

8. The impingement cooling structure according to claim 6, wherein an angle of the indentation with respect to the first wall is greater than an angle of the flow diverter with respect to the second wall.

9. The impingement cooling structure according to claim 1, wherein the first wall is a cold wall and the second wall is a hot wall.

10. The impingement cooling structure according to claim 9, wherein the first wall is a flow sleeve of a combustor and the second wall is a liner or transition piece of the combustor.

11. The impingement cooling structure according to claim 9, wherein the first wall is an inner wall defining a cavity of a turbine vane, and the second wall is an outer wall spaced apart from the inner wall and defining a contour of the turbine vane.

12. The impingement cooling structure according to claim 9, wherein the first wall is an inner wall defining a cavity of a turbine blade, and the second wall is an outer wall spaced apart from the inner wall and defining a contour of the turbine blade.

13. The impingement cooling structure according to claim 1, wherein the bypass channel is in a form of a tunnel, covered on a top thereof, in the flow diverter configured to be open toward both sides of the ridges along the flow channel.

14. A turbomachine component for a gas turbine, the turbomachine component comprising:

an airfoil having a first wall defining a cavity of the turbomachine component and a second wall spaced apart from the first wall and defining a contour of the turbomachine component;

a flow channel formed, in a transverse direction, between the first wall and the second wall facing the first wall;

a plurality of impingement cooling holes disposed in the first wall such that the plurality of impingement cooling holes are spaced apart from each other along the transverse direction of the flow channel; and a flow diverter convexly protruding from a surface of the second wall in each space between injection axes of the plurality of impingement cooling holes, wherein the flow diverter includes a bypass channel, formed in the transverse direction, passing through ridges of both sides along the flow channel, the flow channel and the bypass channel being disposed in the same transverse direction, wherein a flow axis of the bypass channel is disposed to intersect with an axis of an adjacent impingement cooling hole from among the plurality of impingement cooling holes to provide a smooth flow of a cooling air injected from the adjacent impingement cooling hole through the bypass channel.

15. A gas turbine comprising a turbomachine component, wherein the turbomachine component is according to claim 14.

* * * * *